United States Patent [19]

Osborne

[11] 4,401,162

[45] Aug. 30, 1983

[54] IN SITU OIL SHALE PROCESS

[75] Inventor: John S. Osborne, Indianapolis, Ind.

[73] Assignee: Synfuel (an Indiana limited partnership), Indianapolis, Ind.

[21] Appl. No.: 310,786

[22] Filed: Oct. 13, 1981

[51] Int. Cl.[3] ..... E21B 43/00

[52] U.S. Cl. ..... 166/248; 166/60; 166/280

[58] Field of Search ..... 166/248, 60, 280

[56] References Cited

U.S. PATENT DOCUMENTS

| | | | |
|---|---|---|---|
| 2,703,619 | 3/1955 | Sutherlin | 166/280 |
| 3,149,672 | 9/1964 | Orkiszewski et al. | 166/60 X |
| 3,547,192 | 12/1970 | Claridge | 166/272 X |
| 3,620,300 | 11/1971 | Crowson | 166/60 X |
| 3,701,383 | 10/1972 | Richardson et al. | 166/280 |
| 4,030,549 | 6/1977 | Bouck | 166/281 X |
| 4,135,579 | 1/1979 | Rowland et al. | 166/248 |

*Primary Examiner*—Ernest R. Purser

*Assistant Examiner*—Thuy M. Bui

*Attorney, Agent, or Firm*—Frost & Jacobs

[57] ABSTRACT

The method and improvement for recovery of hydrocarbons in situ from subterranean oil shale formations is disclosed by forming generally horizontal electrodes from the injection of molten metal into preheated or unheated fractures of the formation. A nonconductive spacing material is positioned in the casing of the bore hole between the electrodes. A fracture horizontally intermediate between the metallic electrodes is propped with a nonconductive granular material. Unterminated standing waves from a radio frequency (R.F.) generator are passed between the electrodes so as to heat the oil shale formation. The hydrocarbons in the formation are vaporized and are recovered at the surface by their migration through the intermediate fracture and tubing. By this method radial metallic electrodes can be formed at various depths throughout a subterranean oil shale formation so as to vaporize the hydrocarbons contained within the oil shale formation.

24 Claims, 3 Drawing Figures

IN SITU OIL SHALE PROCESS

BACKGROUND OF THE INVENTION

1. Field of the Invention

This invention relates to the recovery of hydrocarbons from subterrenean oil shale formations. A method is provided for the in situ heating of the subterranean oil shale formation using two horizontal, vertically spaced metallic electrodes formed from cooling molten metal in fractures of the oil shale formation. More particularly, the invention relates to the recovery of hydrocarbons from the formation by drilling a bore hole, fracturing the oil shale formation near the upper and lower boundaries of the formation, injecting molten metal into the relatively horizontal fractures, allowing the metal to cool to form vertically spaced metallic electrodes, providing a radio frequency transmission line or coaxial cable between the electrodes, and inducing unterminated standing waves in the upper and lower metallic electrodes and in the oil shale formation therebetween by means of a radio frequency generator.

2. Brief Description of the Prior Art

Subterannean oil shale formations contain relatively large amounts of valuable hydrocarbons, but the large scale commercial recovery of these hydrocarbons has been hindered by economical and environmental constraints. Deep mining and strip mining techniques such as those used to mine coal have proved to be an inefficient method of recovering the hydrocarbons due to the large amount of bulk shale which must be extracted to produce the hydrocarbons. Additionally, these techniques negatively affect the environment and a large amount of unusable rock byproduct must be disposed of.

To avoid these difficulties numerous in situ processes of heating the oil shale within the subterranean formation have been proposed. Application of heat to the oil shale rock increases the porosity and permeability of the oil shale. Upon pyrolysis, the oil shale yields a condensable liquid which can be refined into hydrocarbons including petroleum products.

Processes by which super-heated steam or hot liquid had been injected into the oil shale formation have all proved to be commercially unacceptable since an effective flow of kerogens from the formation could not be readily achieved. These techniques also do not allow for the uniform heating of the oil shale formation due to the low thermal conductivity of the rock.

Other techniques have also been proposed but these have met similar disadvantages. Partial combustion of the hydrocarbons within the subterranean oil shale formation is generally inefficient, environmentally damaging, and difficult to control adequately. Infusion of heat energy to the oil shale formation by electrical induction heating likewise fails to provide a commercially adequate recovery of hydrocarbons due to the limited thermal and electrical conductivity of the bulk formations.

It has been proposed that the uniform heating of the rock formation can be achieved by using ratio frequency (R.F.) electrical energy which corresponds to the dielectric absorption characteristics of the rock formation. An example of such techniques is described in U.S. Pat. No. 4,140,180 and 4,144,935 in which a plurality of vertical conductors are inserted into the rock formation and bound a particular volume of the formation. A frequency of electrical excitation is selected to attain a relatively uniform heating of the rock formation.

Similarly, U.S. Pat. No. 4,135,579 and 4,196,329 describe a method and apparatus by which an alternating electrical field is produced between vertical electrode structures inserted into the subterranean formation. Temperature gradients within the rock formation result from the electrical field so as to fracture the rock body. Modification of this technique is described in U.S. Pat. No. 4,140,179 in which the amount of liquid water in the rock formation is reduced prior to supplying the electric field in order to decrease the temperature needed for pyrolysis of the hydrocarbons.

The difficulty with the above-described techniques using R.F. energy to heat the formation is the necessity of implanting an electrode within the subterranean rock formation at a precise distance. The electrodes in these processes are described to be pipes, transmission lines, conductive plates, and variations thereof. Such an insertion and the proper spacing thereof has proved to be difficult to achieve, time consuming, costly, and inefficient.

There have been some suggestions of forming fractures directly within the rock formation and applying heat to the formation in order to recover hydrocarbons from the formation. U.S. Pat. No. 4,030,549 discloses the injection of the reactive slurry comprising finely divided aluminum and a reactive metal oxide into a fracture and the subsequent ignition of the slurry by a thermite reaction to form a molten metal in the fracture system. U.S. Pat. No. 3,149,672 suggests propping fractures in the rock formation with particles of an electrical conductor, such as aluminum, iron or copper spheres, and connecting the fractures with a source of electric current. However, these methods lack the ease and efficiency which results from directly injecting molten metal into the fracture without the need for a subsequent chemical reaction within the fracture, or without uncertainty in obtaining suitable electrical conduction.

It is an object of the present invention to provide an in situ pyrolysis process of heating hydrocarbons contained in subterranean oil shale formations, in such a manner that relatively large amounts of hydrocarbons are recovered.

A further object of the present invention is the provision of a method by which relatively horizontal metallic electrodes vertically spaced apart are formed in the subterranean formation between which unterminated standing waves induced by a radio frequency generator can be passed.

It is an object of the present invention to recover vaporized hydrocarbons from the in situ heating of a subterranean oil shale formation in an economical and efficient manner which may require only a single bore hole, with a minimum of adverse environmental impacts.

Further objects and advantage of this invention will become apparent in study of the following portion of the specifications, claims, and the attached drawings.

SUMMARY OF THE INVENTION

Applicant has devised a method for the recovery of hydrocarbons from subterranean oil shale formations, including the steps of drilling a bore hole from the surface substantially to the bottom of the oil shale formation, inserting a metallic casing therein, fracturing the oil shale generally horizontally in at least two vertically spaced locations, propping the fractures with an electrically conductive material and applying electromagnetic energy between these fractures for the inductive heating of the oil shale formation, the improvement comprising injecting molten metal into a lower generally horizontal fracture, providing a nonconductive spacing material in the casing above the fracture, and injecting molten metal into an upper generally horizontal fracture above the spacer, thereby forming a pair of vertically spaced, metallic electrodes in the upper and lower fractures.

Applicant in one embodiment of the invention has devised a method for the recovery of hydrocarbons from subterranean oil shale formations in which a bore hole is drilled from the surface to the lower region of the oil shale formation; a metallic casing is inserted into the bore hole; the oil shale formation is fractured generally horizontally adjacent to the lowermost end of the casing; molten metal is injected into the generally horizontal fracture to form a metallic electrode in the fracture; the oil shale formation is again fractured generally horizontally adjacent to the upper boundary of the oil shale formation; molten metal is injected into this fracture to form a second metallic electrode; a passage is formed through the second electrode within the casing; the oil shale formation is fractured generally horizontally intermediate between the first and second electrodes and this intermediate fracture is propped with nonconductive granular materials; the casing is severed in at least one location intermediate the electrodes; a metallic tubing is inserted centrally in the casing to form an electrical connection between the lower metallic electrode and the surface and this tubing is insulated from the casing; unterminated standing waves are induced in the upper and lower metallic electrodes and in the oil shale formation therebetween by means of a radio frequency generator; the oil shale formation is heated sufficiently to vaporize hydrocarbons therein; and the vaporized hydrocarbons are recovered at the surface through the intermediate fracture and tubing.

DETAILED DESCRIPTION

Figure 1:
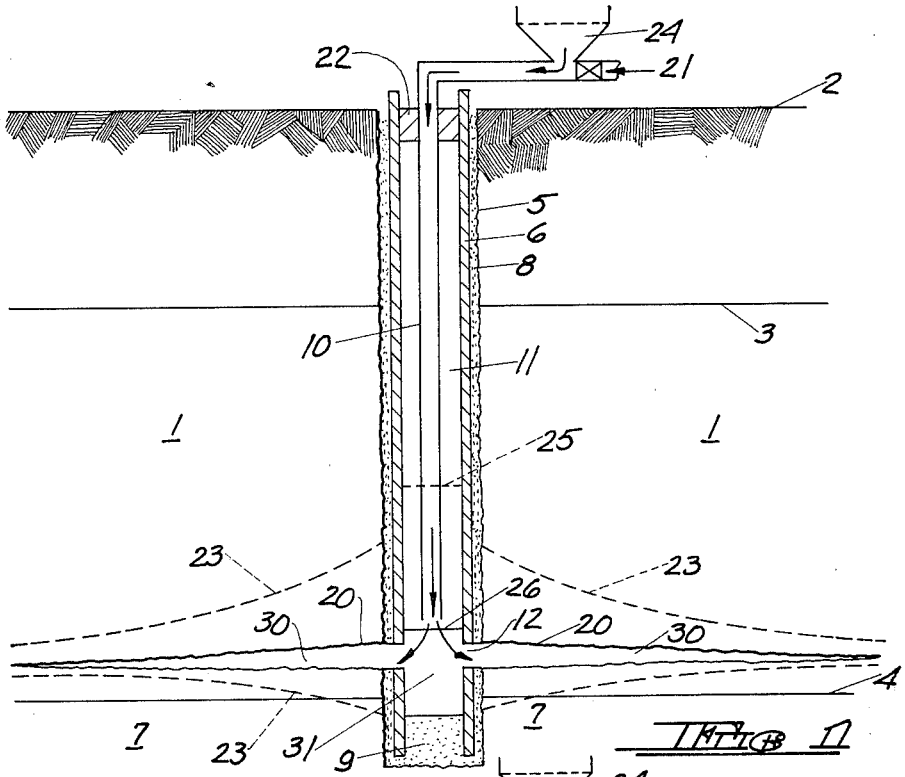
FIG. 1 is a vertical sectional view of a bore hole entering a subterranean oil shale formation illustrating the formation of a lower metallic electrode.

Referring now to FIG. 1, a cross-sectional view of an oil shale formation indicated generally at 1 is shown below the surface of the earth 2. The extent of the oil shale formation 1 is defined by boundaries 3 and 4 at the top and bottom of the oil shale formation respectively.

A bore hole 5 is drilled through the oil shale formation 1 by using conventional rotary drilling techniques to reach a depth in the underburden 7 below the bottom boundary 4. A metallic casing 6 of high temperature and pressure rating is inserted into the bore hole 5 along the entire length of the bore hole. A cement outer coating 8, especially formulated to withstand high temperatures, is injected between the casing 6 and the bore hole along the entire length of the casing. This cementing of the casing may be achieved by conventional oil well cementing techniques. A cement base 9 fills the bottom of the bore hole 5 at a position in the underburden 7 just below the bottom boundary 4 of the oil shale formation 1. A rotatable high pressure tubing 10 is inserted into the casing 6 with an annular space 11 therebetween.

A lower casing slot 12 of 360° is cut completely through the casing 6 and cement 8 to the oil shale formation 1. A standard technique to effectuate this cutting is a process by which fine sand particles are entrained in water and pumped down the tubing 10. After the casing slot 12 has been cut, the water-sand mixture is returned to the surface 2 through the annulus 11 circumscribing the tubing 10. A lower fracture 20, which is generally horizontal relative to the surface 2, is formed by standard techniques used in the oil industry. To form the fracture 20, pressure is applied down through the casing slot 12 so as to fracture the oil shale formation 2 adjacent to the casing slot 12. Once the formation is parted, a sufficient amount of water is injected into the widening fracture to cause the lower fracture 20 to extend approximately to a 100 foot radius from the casing slot 12. However, various other radius lengths can be achieved depending upon the extent of such deposits. After the fracture 20 is formed, bore hole 5 is opened at the surface 2 to allow some of the injected water to flow back from the fracture 20 to the surface 2.

The lower fracture 20 may be further cleansed of water by injecting gas or steam supplied at 21 through the tubing 10 into the fracture. The bore hole 5 is sealed at the surface 2 by a high pressure-temperature seal 22. The pressure resulting from the injection of gas or steam cleanses the fracture by forcing the remaining water out of the casing 6 and by displacing the water remaining near the casing slot 12 to distant points in the periphery of the expanding fracture 20. Air, nitrogen, or any other suitable gas at low temperature may be used as the injected gas in this technique.

The fracture 20 is preferably preheated to or above the melting point of the molten metal which is to be used by further injecting hot gas or superheated steam vapor through the tubing 10 into the fracture 20. Preferably a metal or alloy is used having a melting point ranging between about 300° and 700° C. Little heat loss occurs from the bore hole 5 during this procedure due both to a reflective coating which may be placed on the casing 6 and the tubing 10 and to the static vapor or gas in the annulus 11 acting as an insulator. The high temperature pressure seal 22 allows pressure to build within the casing 6 so as to force the hot gas or vapor into the fracture 20 and further expand the fracture. Since the oil shale formation 1 conducts heat poorly, this technique allows the fracture 20 to be readily heated outwardly. The melting point isotherms 23 of the oil shale formation 1 are formed by this injection of gas or vapor.

During or subsequent to the heating of the casing 6 and the fracture 20 by the above process, molten metal from a container 24 is allowed to flow gravitationally down tubing 10 toward the fracture 20. Preferably, the metal may be aluminum, aluminum alloys, lead, lead alloys, zinc, or zinc alloys. When the hydrostatic head 25 of the column of molten metal in the tubing 10 exceeds the formation fracture pressure of the oil shale formation, the molten metal flows and extends radially into the fracture 20. During the injection of the molten metal into the fracture 20, the metal remains molten since the oil shale formation 1 surrounding the fracture 20 has been previously heated to a temperature above the melting point of the metal by the injection of hot gas or vapor into the fracture 20.

After the fracture 20 has been filled by the molten metal, hot gas is injected into the tubing 10 to displace the metal remaining in the tubing into the fracture 20. Sufficient pressure is maintained in the tubing 10 to sustain a level 26 of the molten metal in the tubing 10 a short distance above the casing slot 12.

After a period of time, the molten metal in the fracture 20 will cool and solidify into a lower metallic electrode 30. The electrode 30 is connected to casing 6 by a solidified metal plug 31 positioned on top of the cement base 9.

Figure 2:
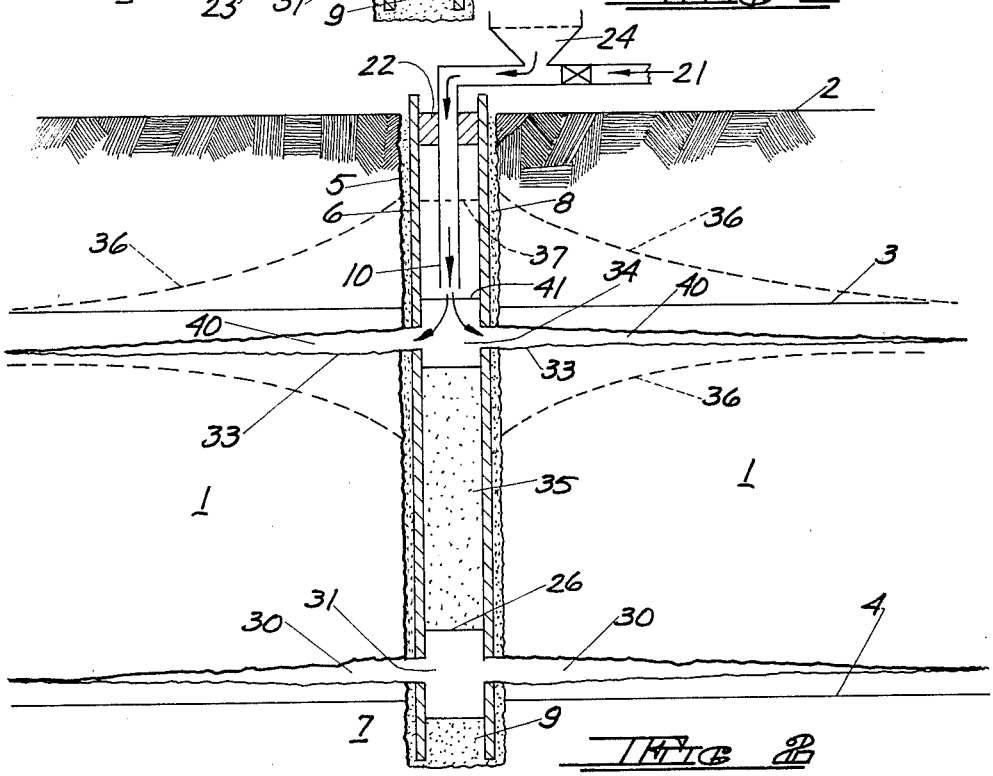
FIG. 2 is a vertical sectional view of a bore hole penetrating a subterranean oil shale formation illustrating the production of an upper metallic electrode.

Referring now to FIG. 2, in like manner, an upper fracture 33 is formed at a distance just below the upper boundary 3 which separates the oil shale formation from the overburden between the surface 2 and upper boundary 3. An upper casing slot 34 of 360° is cut through both the casing 6 and cement 8 to allow for the passage of gas, water, and molten metal. After the slot 34 is cut, the sand used in the cutting process is allowed to accummulate in the bore hold 5 below the slot 34. The sand acts as a nonconductive spacer 35 although other nonconductive material may be used to fill the space below slot 34. The spacer 35 prevents the flow of gas, vapor, or molten metal down the bore hole 5. The preferred injection of hot gas or vapor into the fracture 33 establishes a melting isotherm 36 of the oil shale formation 1.

As disclosed for the lower fracture, molten metal is injected into the tubing 10 and it enters into the fracture 33 when the hydrostatic head 37 on the column of molten metal in the tubing 10 exceeds the formation fracture pressure of the oil shale. When the molten metal solidifies within the upper fracture 33, an upper metallic electrode 40 generally horizontal to the surface 2 is formed. The electrode 40 is connected to a solidified metal plug 41 within the casing 6.

Figure 3:
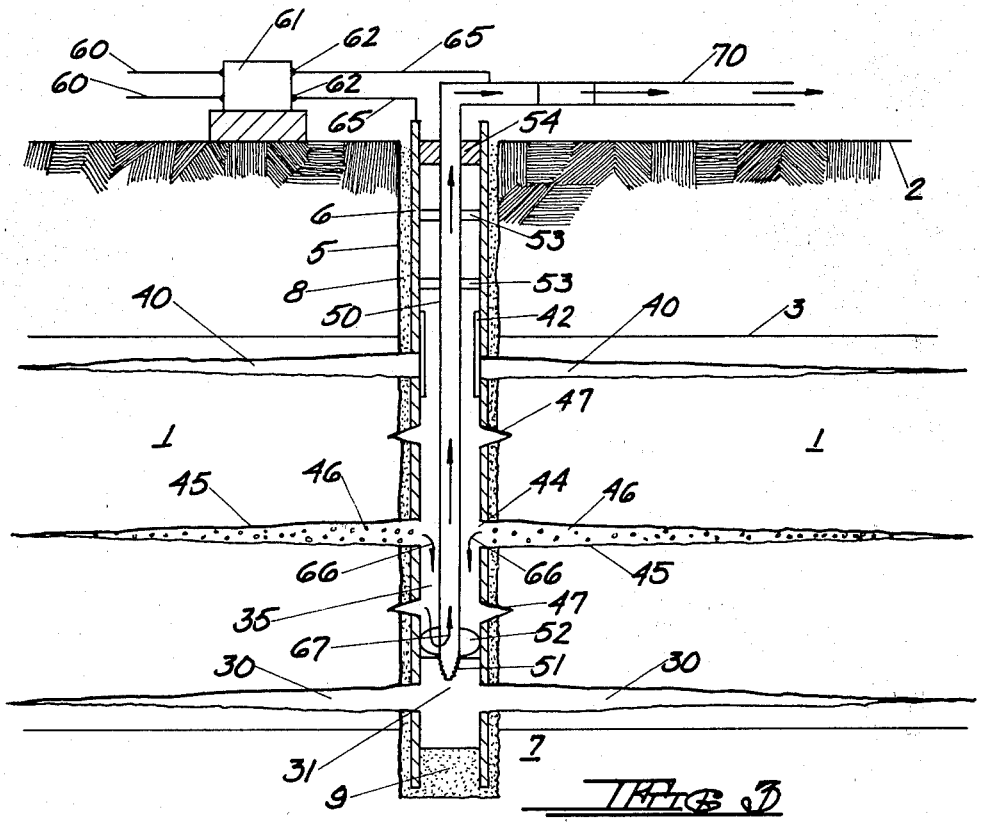
FIG. 3 illustrates a vertical sectional view of a bore hole penetrating a subterranean oil shale formation in completed condition for recovery of hydrocarbons from the shale.

Now referring to FIG. 3, after formation of the electrode 40, the metal plug 41 is drilled through to form a central passage while leaving intact a sheath 42 connected to the casing 6 and electrode 40. Spacer material 35 is removed downwardly, by drilling and washing, to a point approximately intermediate the upper electrode 40 and the lower electrode 30.

In the same manner as slots 12 and 34 were cut, a 360° casing slot 44 is cut through the casing 6 and cement 8 intermediate the upper and lower metallic electrodes. A fracture 45 is formed by injecting hydraulic pressure through slot 44. The pressure can be applied directly down the bore hole 5 or through a tubing similar to 10 inserted into the casing 6.

Using standard oil well techniques, a propping agent 46 of nonconductive granular material such as sand is suspended in gelled water and placed into fracture 45. After the gel breaks, the water returns to the bore hole 5 and leaves the propping agent 46 within the fracture 45 to hold the fracture 45 open and to provide a permeable path back to the bore hole 5.

By the same technique that slots 12, 34 and 44 were cut, two or more slots 47 are cut 360° around the casing 6 so as to prevent electrical connection through the casing 6 between the upper electrode 40 and the lower electrode 30.

As shown in FIG. 3, a metallic tubing 50 is positioned centrally in the casing 6 so as to act as a central conductor electrically connecting the lower electrode 30 with the surface 2. The tubing 50 is drilled into the metal plug 31 by a self-tapping thread 51. A spring centralizer 52, which may be manufactured from metal, centers the tubing 50 within the bore hole 5 and establishes electrical contact between the casing 6 and the tube 50. A series of low dielectric loss centralizers 53 centers the upper part of the tubing 50 in bore hole 5. A low loss dielectric pressure seal 54 is positioned around tube 50 at the mouth of the bore hole 5. The seal 54 maintains sufficient gas pressure within the casing 6 to cause a flow of products from the oil shale formation through the tubing 50.

An alternating current power supply 60 is led into a generator 61 which produces radio frequency (R.F.) energy waves. The terminals 62 of the generator are connected by wires or cables 65 to the casing 6 and the central tubing 50 which comprise electrically an R.F. transmission line or coaxial cable. The transmission line terminates at the electrodes 30 and 40, respectively. Thus the R.F. energy produced by the generator 61 is carried to the electrodes 30 and 40 with little loss of energy.

Because the electrodes are unterminated, standing waves are induced in the upper electrode 40, lower electrode 30 and in the shale formation 1 therebetween. The waves generate sufficient heat in the oil shale formation 1 as to vaporize the kerogen contained therein. These pyrolysis products migrate through the microfractures and pores of the shale toward the intermediate fracture 45. Gravitationally the pyrolysis products move down the paths shown by arrows 66 in the casing 6 to the ports 67 at the bottom of the tubing 50. The pyrolysis products come up through the tubing 50 to the surface 2 due to the vapor pressure in the tubing 50. At the surface 2, the vaporized products are conducted away by conduit 70 and are condensed and separated into the various components by conventional apparatus (not shown).

The unterminated standing waves from the R.F. energy generator are induced by introducing electricial excitation to the oil shale formation 1 to establish alternating electrical fields within the oil shale formation. The frequency of the excitation is selected as a function of the volume dimensions between the electrodes 30 and 40 so as to confine the electrical field generated to the volume between the electrodes.

I claim:

1. In a method for the recovery of hydrocarbons from subterranean oil shale formations, including the steps of drilling a bore hole from the surface substantially to the bottom of an oil shale formation, inserting a metallic casing therein, fracturing the oil shale generally horizontally in at least two vertically spaced locations, propping the fractures with an electrically conductive material, and applying electromagnetic energy between said fractures for inductive heating of said oil shale, the improvement which comprises injecting molten metal into a lower generally horizontal fracture, providing a non-conductive spacer material in said casing above said fracture, and injecting molten metal into an upper generally horizontal fracture above said spacer, thereby forming a pair of vertically spaced, metallic electrodes in said upper and lower fractures.

2. The improvement claimed in claim 1, wherein said fractures are preheated prior to said steps of injecting molten metal.

3. The improvement claimed in claim 1, including the step of injecting cement between said casing and said bore hole.

4. The improvement claimed in claim 3, wherein said fractures are produced by cutting holes in said casing and applying fluid under pressure through said holes, whereby to part said oil shale formation and extend said fractures about 100 feet radially of said bore hole.

5. The improvement claimed in claim 4, including the step of displacing said fluid after release of pressure thereon by injecting gas under pressure into said casing.

6. The improvement claimed in claim 1, including the steps of drilling through said upper metallic electrode within said casing after solidification of the molten metal, leaving a conductive sheath connecting said casing to said upper electrode, and removing said spacer material to a depth intermediate said upper and lower electrodes.

7. The improvement claimed in claim 6, including the steps of cutting a slot through said casing intermediate said upper and lower electrodes, forming a further generally horizontal fracture in said oil shale formation intermediate said metallic electrodes by injection of liquid under pressure through said slot, and propping said fracture with non-conductive granular material.

8. The improvement claimed in claim 7, including the step of severing said casing in at least one location intermediate said upper and lower electrodes whereby to prevent electrical connection through said casing between said upper and lower electrodes.

9. The improvement claimed in claim 8, including the steps of inserting metallic tubing centrally into said casing to form an electrical connection between said lower metallic electrode and the surface, and insulating said tubing from said casing.

10. The improvement claimed in claim 9, including the step of connecting terminals of a radio frequency energy generator to said casing and said metallic tubing whereby to induce unterminated standing waves in said upper and lower metallic electrodes and in said oil shale formation therebetween, said waves generating heat in said formation sufficient to vaporize hydrocarbons therein.

11. The improvement claimed in claim 10, including the step of recovering said vaporized hydrocarbons at the surface through said intermediate fracture and said tubing.

12. The improvement claimed in claim 1, wherein said molten metal is aluminum, aluminum alloys, lead, lead alloys, zinc, or zinc alloys.

13. A method for the recovery of hydrocarbons from subterranean oil shale formations, comprising the steps of:

drilling a bore hole from the surface to the lower region of an oil shale formation;

inserting a metallic casing in said bore hole:

fracturing the oil shale formation generally horizontally adjacent the lowermost end of said casing;

injecting molten metal into the generally horizontal fracture whereby to form a metallic electrode in said fracture extending radially from said casing;

fracturing the oil shale formation generally horizontally adjacent the upper boundary of said oil shale formation;

injecting molten metal into the fracture adjacent the upper boundary of said oil shale formation whereby to form a second metallic electrode extending radially from said casing;

forming a passage through said second electrode within said casing;

fracturing the oil shale formation generally horizontally intermediate said metallic electrodes and propping said fracture with non-conductive granular material;

severing said casing in at least one location intermediate said electrodes;

inserting metallic tubing centrally of said casing to form an electrical connection between the lower metallic electrode and the surface and insulating said tubing from said casing;

inducing unterminated standing waves in the upper and lower metallic electrodes and in said oil shale formation therebetween by means of a radio frequency generator, whereby to generate heat in said oil shale formation sufficient to vaporize hydrocarbons therein; and recovering said vaporized hydrocarbons at the surface through said intermediate fracture and said tubing.

14. The method claimed in claim 13, wherein the lowermost fracture and the fractures adjacent the upper boundary of said formation are preheated prior to the steps of injecting molten metal thereinto approximately to the melting point of the metal.

15. The method claimed in claim 14, wherein said steps of injecting said molten metal into said fractures includes permitting said molten metal to flow downwardly by gravity and thereafter applying gas under pressure into said casing above the level of said molten metal, thereby forcing said molten metal outwardly into said fractures.

16. The method claimed in claim 13, including the step of injecting cement between said casing and said bore hole prior to said steps of fracturing the oil shale formation.

17. The method claimed in claim 16, wherein the fracture adjacent the lowermost end of said casing is produced by cutting through the casing and cement adjacent the lowermost end thereof, applying fluid under pressure at the point where said casing and cement are cut, whereby to part said oil shale formation and extend the fracture about 100 feet radially of said bore hole, and thereafter injecting a gas under pressure to force the remaining fluid out of said casing and to the periphery of said fracture.

18. The method claimed in claim 16, wherein the fracture adjacent the upper boundary of said oil shale formation is produced by cutting through said casing and cement adjacent said upper boundary, applying fluid under pressure at the point where said casing and cement are cut, whereby to part said oil shale formation and extend said fracture about 100 feet radially of said bore hole, and permitting granular material used in cutting through said casing and cement to accumulate below said fracture adjacent the upper boundary of said oil shale formation to serve as a spacer material.

19. The method claimed in claim 18, including the step of removing said spacer material to a depth intermediate said metallic electrodes, and wherein said step of fracturing the oil shale formation generally horizontally intermediate said metallic electrodes comprises cutting a slot through said casing and cement intermediate said upper and lower electrodes, and injecting liquid under pressure through said slot.

20. The method claimed in claim 17 or 18, wherein said step of cutting through said casing and cement is effected by pumping sand entrained in water under pressure through jet openings in a tube and rotating said jet openings horizontally whereby said casing and cement are severed by abrasion throughout the periphery thereof.

21. The method claimed in claim 13, wherein said step of forming a passage through said second electrode within said casing comprises drilling through said second electrode within said casing after solidification of the molten metal, leaving an electrically conductive sheath connecting the interior of the casing to said second electrode.

22. The method claimed in claim 13, wherein said unterminated standing waves are induced by introducing electrical excitation to said oil shale formation between said electrodes to establish alternating electric fields, the frequency of said excitation being selected as a function of the volume dimensions between said electrodes so as to establish substantially non-radiating electric fields which are substantially confined in said volume.

23. The method claimed in claim 13, wherein said step of propping said fracture intermediate said metallic electrodes with non-conductive granular material comprises injecting sand suspended in gelled water into said fracture under pressure.

24. The method claimed in claim 13, wherein said molten metal is aluminum, aluminum alloys, lead, lead alloys, zinc, or zinc alloys.

* * * * *